US011779995B2

(12) United States Patent
Shen

(10) Patent No.: US 11,779,995 B2
(45) Date of Patent: Oct. 10, 2023

(54) TIE PLIER

(71) Applicants: ZHUJI ITOP HARDWARE TOOLS CO., LTD., Zhuji (CN); ZHEJIANG IWISS ELECTRIC CO., LTD., Leqing (CN)

(72) Inventor: Yuejuan Shen, Zhuji (CN)

(73) Assignees: ZHUJI ITOP HARDWARE TOOLS CO., LTD., Zhuji (CN); ZHEJIANG IWISS ELECTRIC CO., LTD., Lishui (CN)

( * ) Notice: Subject to any disclaimer, the term of this patent is extended or adjusted under 35 U.S.C. 154(b) by 4 days.

(21) Appl. No.: 17/652,401

(22) Filed: Feb. 24, 2022

(65) Prior Publication Data

US 2023/0201909 A1 Jun. 29, 2023

(30) Foreign Application Priority Data

Dec. 23, 2021 (CN) ..... 202123340251.9

(51) Int. Cl.
*B21F 15/04* (2006.01)
*B65B 13/02* (2006.01)

(52) U.S. Cl.
CPC ..... *B21F 15/04* (2013.01); *B65B 13/025* (2013.01)

(58) Field of Classification Search
CPC ..... B65B 13/027; B65B 13/18; B65B 13/185; B65B 13/22; B65B 13/24
USPC ..... 140/123.5, 57
See application file for complete search history.

(56) References Cited

U.S. PATENT DOCUMENTS

2005/0115629 A1* 6/2005 Bernard ..... B65B 13/24 140/123.5
2005/0284534 A1* 12/2005 Yu Chen ..... B65B 13/025 140/123.6
2012/0067450 A1* 3/2012 Shafer ..... B65B 13/027 140/123.6
2012/0197257 A1* 8/2012 Knueppel ..... A61B 17/8863 606/74
2015/0239588 A1* 8/2015 Kitago ..... B65B 13/305 140/123.6

FOREIGN PATENT DOCUMENTS

CN 206885415 U 1/2018

* cited by examiner

*Primary Examiner* — Bobby Yeonjin Kim
(74) *Attorney, Agent, or Firm* — Schwegman Lundberg & Woessner, P.A.

(57) ABSTRACT

A tie plier is disclosed, including: a first support fixedly connected with a first handle; a second support rotatably connected to the first support and fixedly connected with a second handle; a first elastic member for driving the first support and the second support to reset; a feed head fixedly connected to the first support and provided with a feed groove; a fastening component provided on the second support and on a same side as the feed head, and provided with a fastening groove; a cutting groove cylindrically provided on the feed head and communicated with the feed groove; and a cutting bit which is semi-cylindrically provided in the cutting groove and is rotatable in the cutting groove. The first support is provided with a rotating shaft for controlling rotation of the cutting bit and a second elastic member for driving the rotating shaft to re set.

13 Claims, 4 Drawing Sheets

TIE PLIER

CROSS-REFERENCE TO RELATED APPLICATIONS

This Non-provisional application claims priority under 35 U.S.C. § 119(a) to Chinese Patent Application No. 202123340251.9, filed on 23 Dec. 2021, the entire contents of which are hereby incorporated by reference in its entirety.

TECHNICAL FIELD

The disclosure relates to a technical field of tie pliers, in particular to a tie plier.

BACKGROUND ART

Ties are widely used to bind and fix wires, devices and other articles. A traditional tie includes a head and a tie body. The tie body is wound around a bound article by encircling the article once, so that a tail of the tie body penetrates through the head of the tie, and the tie body is locked in the head of the tie through a clamping groove provided on the tie body and a clamping part provided on the head, so as to bind and fix the article.

A traditional using way of the tie is to use manpower to tighten and then bind and fix the article. However, a stainless steel tie has a smooth surface and is thinner than a traditional plastic tie in thickness, so friction between a hand and the stainless steel tie is small under action of manpower, which is difficult for the tie to completely bind and fix the article, which leads to damage to wires, devices and other articles with deficient fixing, and needs to be improved.

In view of above problems, a stainless steel tie bundling tool is disclosed in China Patent No. CN201720476527, but the stainless steel tie bundling tool needs to be operated with both hands during in use, which brings great inconvenience to operators.

SUMMARY

1. Problems to be Solved

Aiming at a technical problem that a tie plier in the prior art needs to be operated with both hands and is inconvenient to use, a tie plier is provided in the disclosure, which brings great convenience to operators and is with a simpler and more efficient operation.

2. Solution

To solve the above problems, the technical scheme provided in the disclosure is as follows:

A tie plier includes a first support fixedly connected with a first handle; a second support rotatably connected to the first support and fixedly connected with a second handle; a first elastic member for driving the first support and the second support to reset; a feed head fixedly connected to the first support and provided with a feed groove; a fastening component provided on the second support and on a same side as the feed head, and provided with a fastening groove; a cutting groove cylindrically provided on the feed head and communicated with the feed groove; and a cutting bit which is semi-cylindrically provided in the cutting groove and is rotatable in the cutting groove. The first support is provided with a rotating shaft for controlling rotation of the cutting bit and a second elastic member for driving the rotating shaft to reset. The rotating shaft is fixedly connected with a control handle, and an end of the control handle is extended to between a first handle and a second handle and is located at sides of the first handle and the second handle proximate to the feed groove.

Optionally, the cutting bit is arranged in a lower half circle of the cutting groove, and the end of the control handle is arranged below the cutting bit.

Optionally, the fastening component includes a fastening seat fixedly connected to the second support and a fastener rotatably connected in the fastening seat, a blocking part is fixedly connected above the fastening seat, and a fastening groove is formed between the fastener and the blocking part. The fastener includes a limiting end and a fastening end. The limiting end is proximate to the feed head and the fastening end is away from the feed head.

Optionally, the fastening end is provided with a plurality of fastening teeth.

Optionally, the second support is rotatably connected to the first support through a movable shaft, and the first support is provided with an arc-shaped groove with the movable shaft as a circle center, and two ends of the arc-shaped groove are respectively provided with a first fixed post and a second fixed post, the first fixed post is arranged on the first support and the second fixed post is arranged on the second support. The first elastic member is a spring, and two ends of the spring are respectively sleeved on the first fixed post and the second fixed post.

Optionally, the end of the control handle is fixedly connected with a force applying part.

Optionally, the force applying part is a sphere.

Optionally, the end of the control handle is extended to upper-middle parts of the first handle and the second handle.

Optionally, the tie plier further includes an adjusting component which is arranged on the fastening component and used for adjusting an initial distance between the fastening groove and the blocking part.

Optionally, a protruding end of the adjusting component passes through and out of the blocking part to reduce the initial distance between the fastening groove and the blocking part.

Optionally, a screw connection can be made between the adjusting component and the blocking part to keep a height of the protruding end of the adjusting component protruding from the blocking part adjustable, so as to adjust the initial distance between the fastening groove and the blocking part.

Optionally, a side of the fastening groove facing the blocking part is provided with fastening teeth, and the protruding end of the adjusting component is arranged correspondingly to the fastening teeth of the fastening groove.

Optionally, the adjusting component is a screw element.

Optionally, a medium-strength threadlocker is filled between the screw element and a screw hole of the blocking part to fix a position of the adjusted adjusting component.

Optionally, a spring or gasket is provided between the screw element and the blocking part to fix a position of the adjusted adjusting component.

3. Beneficial Effects

Compared with the prior art, the technical schemes provided in the disclosure have the following beneficial effects:

(1) In this disclosure, the end of the control handle is extended to between the first handle and the second handle and located at sides of the first handle and the second handle proximate to the feed groove, so that the operator can control operations of the control handle, the first handle and the second handle with one hand. When a tail of the tie needs to be cut, the cutting bit can be driven to move in the cutting groove by pushing the control handle with a thumb. At this time, the other hand of the operator can hold an article bundled by the tie, so as to prevent the article from falling and being damaged due to loss of a supporting force after the tail of the tie is cut.

(2) Compared with two-handed operations, the tie plier brings great convenience to the operator, with a simpler and more efficient operation mode, and facilitates reducing of working intensity of the operator.

1. First Support; 2. First Handle; 3. Second Support; 4. Second Handle; 5. First Elastic Member; 6. Feed Head; 61. Feed Groove; 7. Fastening Component; 71. Fastening Groove; 72. Fastening Seat; 73. Fastener; 731. Limiting End; 732. Fastening End; 733. Fastening Teeth; 74. Blocking Part; 75. Adjusting Component; 8. Cutting Groove; 9. Cutting Bit; 10. Rotating Shaft; 11. Second Elastic Member; 12. Control Handle; 121. Force Applying Part; 13. Movable Shaft; 14. Arc-shaped Groove; 141. First Fixed Post; 142. Second Fixed Post.

DETAILED DESCRIPTION

Figure 1:
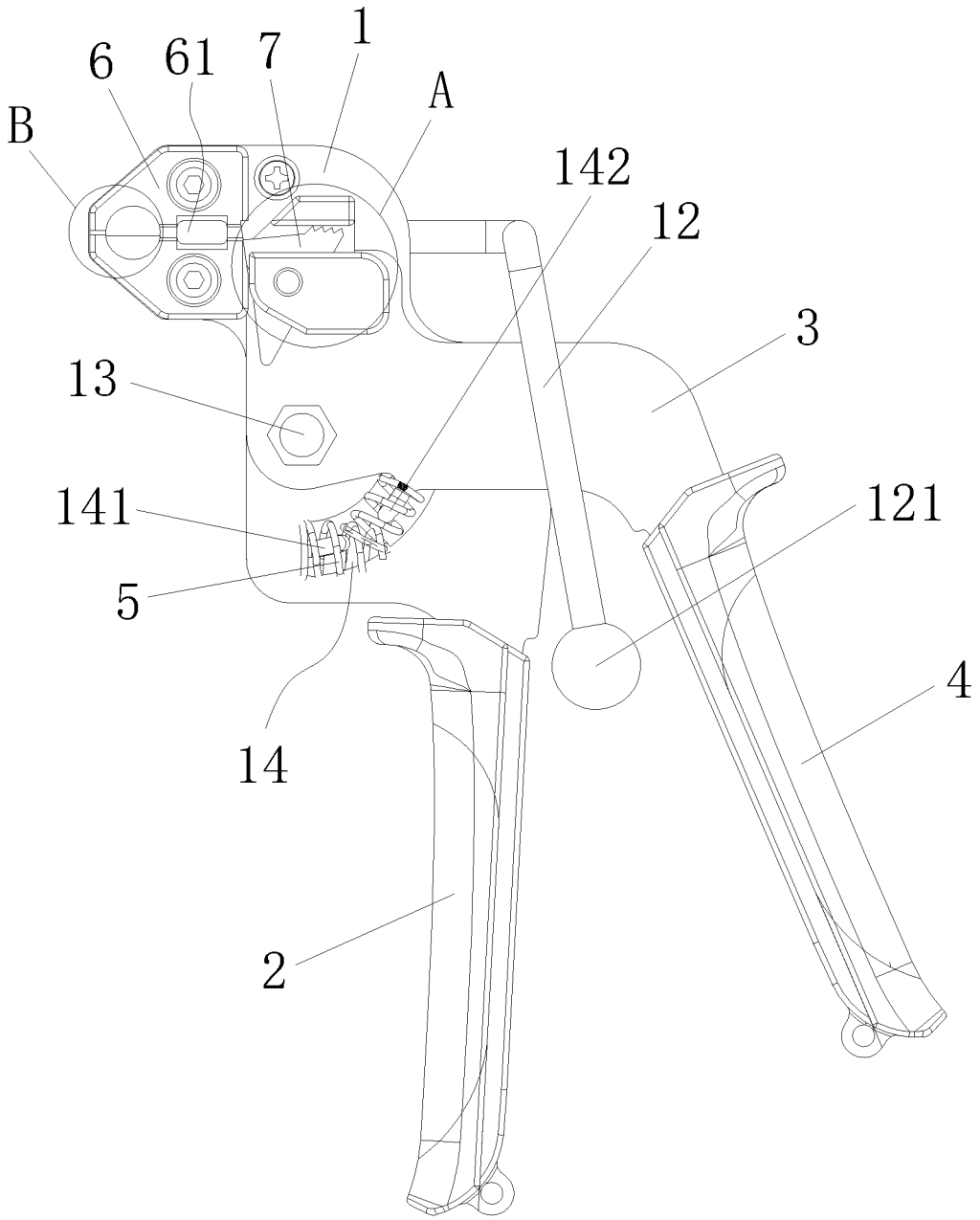
FIG. 1 is a front schematic diagram of a tie plier according to an embodiment of the disclosure.
Figure 2:
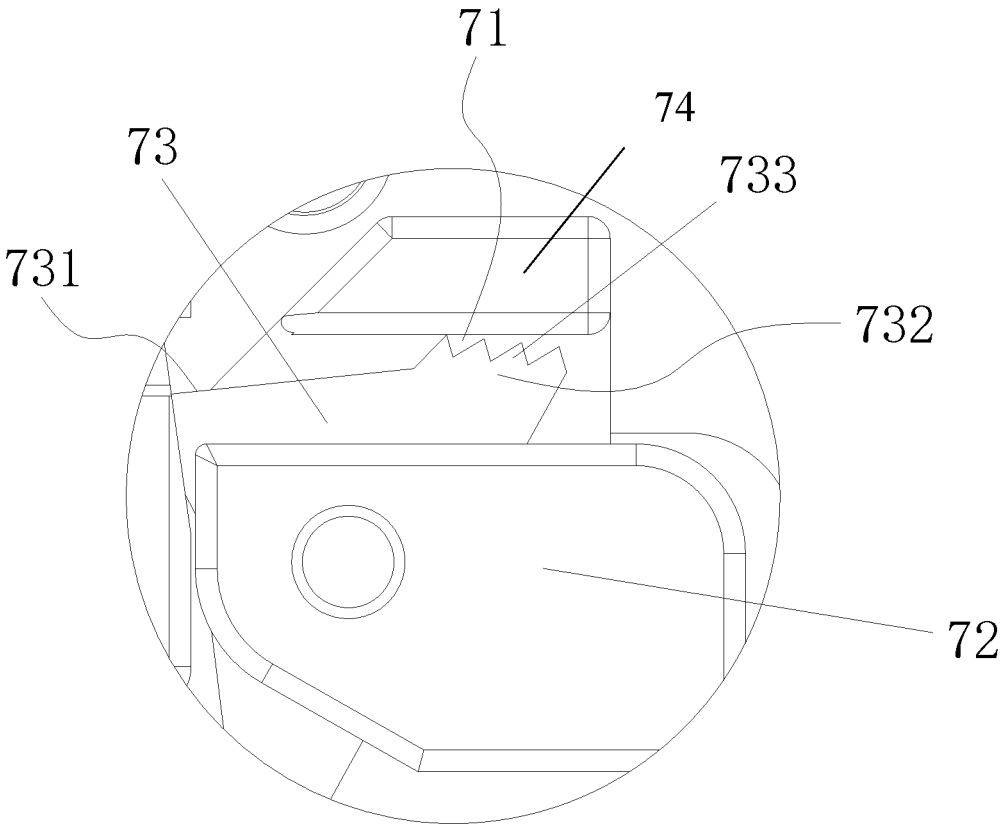
FIG. 2 is a partial schematic diagram at A in FIG. 1.
Figure 3:
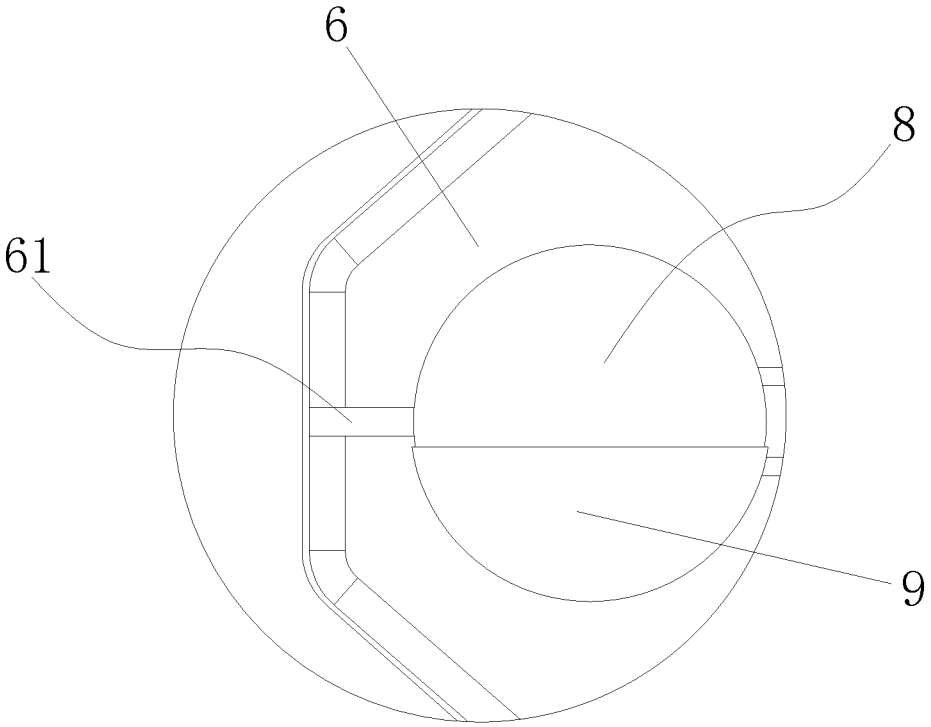
FIG. 3 is a partial schematic diagram at B in FIG. 1.
Figure 4:
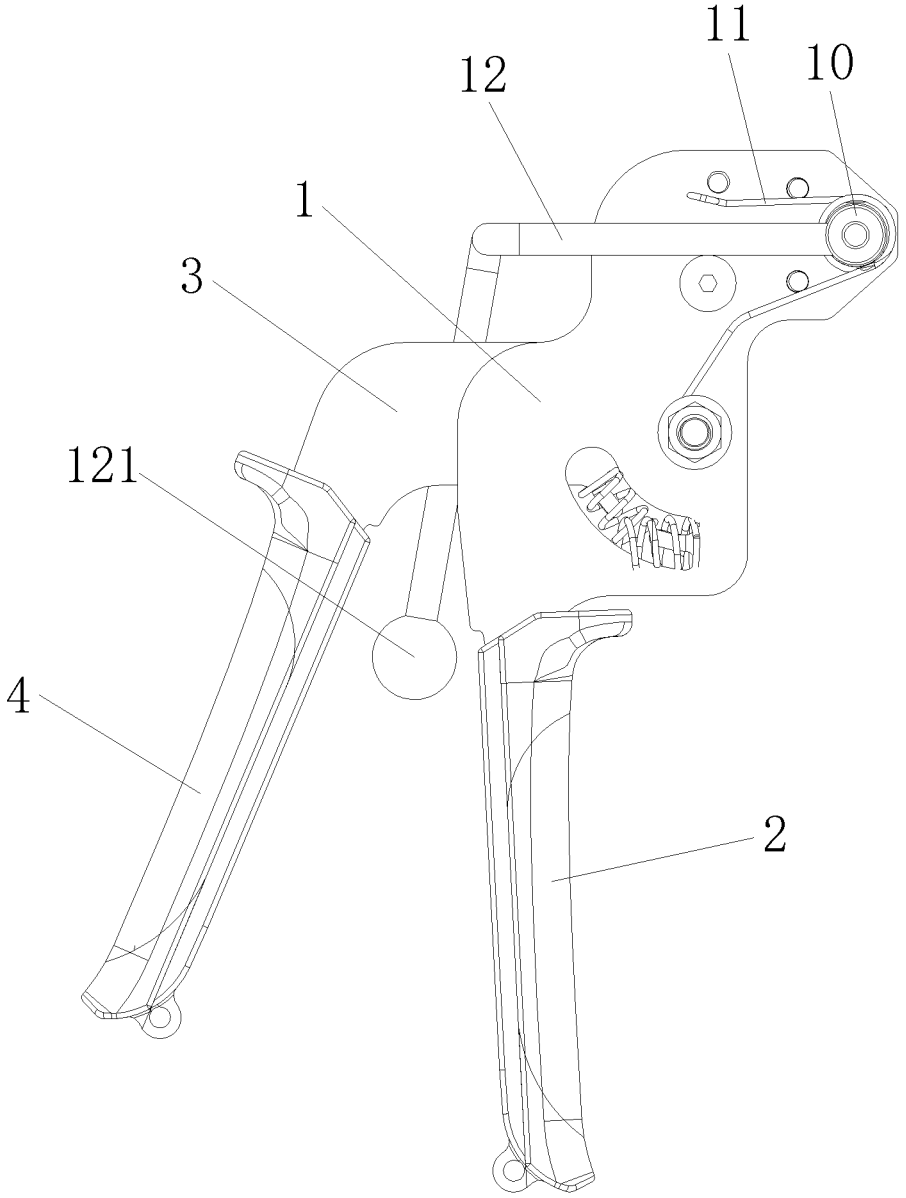
FIG. 4 is a back schematic diagram of a tie plier according to an embodiment of the disclosure.
Figure 5:
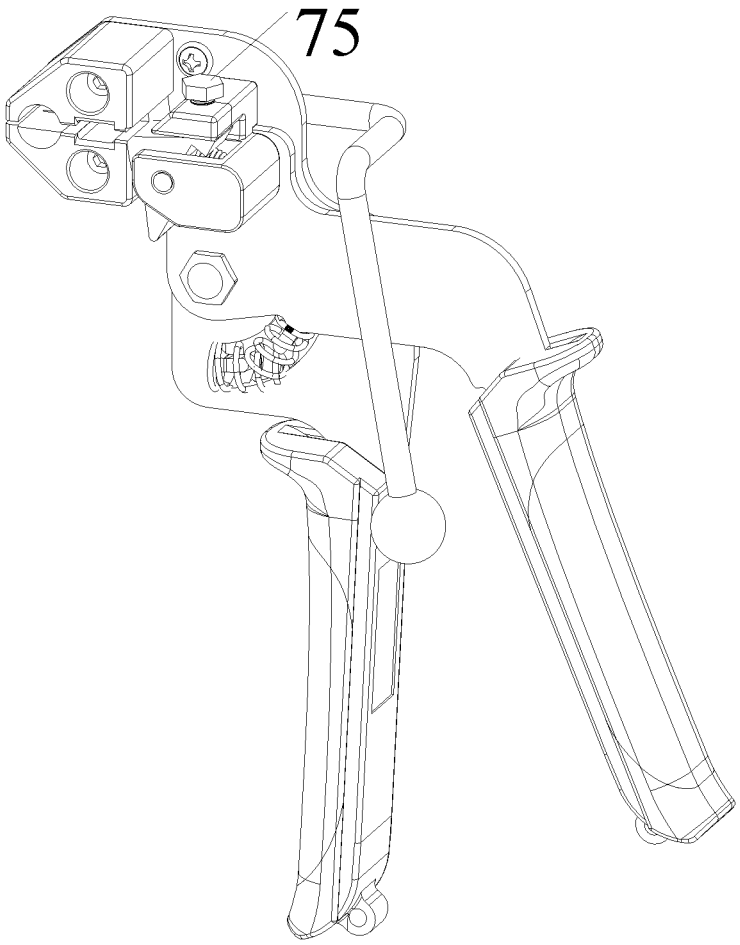
FIG. 5 is a schematic diagram of a tie plier according to another embodiment of the disclosure.
Figure 6:
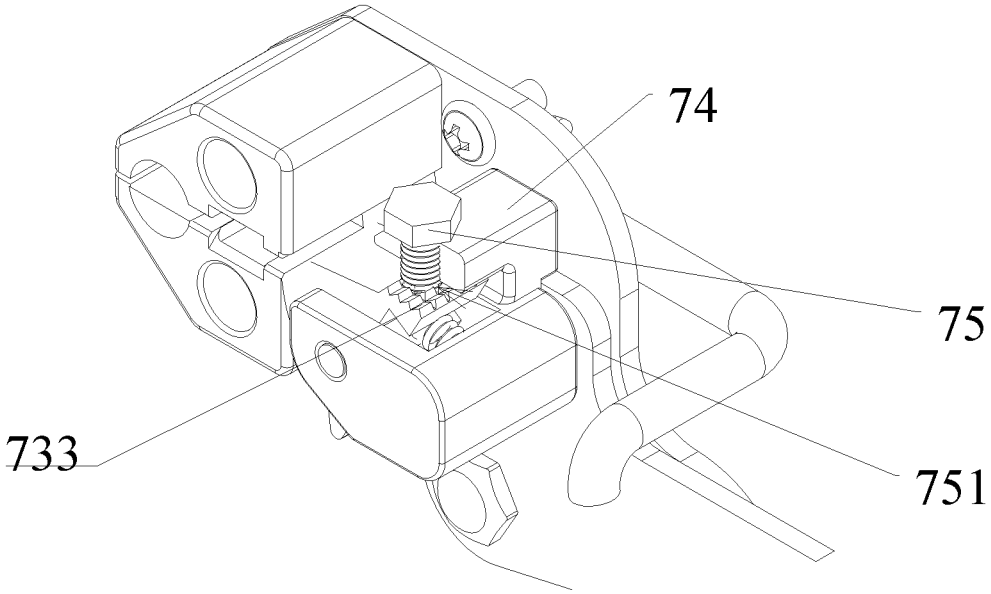
FIG. 6 is a partial schematic diagram of a tie plier according to another embodiment of the disclosure.

In order to further understand contents of the present disclosure, the present disclosure will be described in detail with reference to FIGS. 1 to 4 and examples.

With reference to FIGS. 1-4, a tie plier according to this embodiment includes a first support 1, a lower end of which is fixedly connected with a first handle 2 in a plug-in manner; a second support 3, which is rotatably connected to the first support 1 through a movable shaft 13 and a lower end of which is fixedly connected with a second handle 4 in a plug-in manner; a first elastic member 5 for driving the first support 1 and the second support 3 to reset; a feed head 6 fixedly connected to the first support 1 and provided with a feed groove 61; a fastening component 7 provided on the second support 3 at a same side as the feed head 6, the fastening component 7 being arranged at a rear side of the feed head 6, and a fastening groove 71 being defined in the fastening component 7; a cutting groove 8 cylindrically provided on the feed head 6 and communicated with the feed groove 61, the feed groove 61 passing through a middle of the cutting groove 8; and a cutting bit 9 which is semi-cylindrical provided in the cutting groove 8 and is rotatable in the cutting groove 8. The first support 1 is provided with a rotating shaft 10 for controlling rotation of the cutting bit 9, and a second elastic member 11 for driving the rotating shaft 10 to reset. The second elastic member 11 is a torsion spring. The rotating shaft 10 is integrally formed with the cutting bit 9 and is located at a side of the first support 1 away from the feed head 6. A control handle 12 is fixedly connected to the rotating shaft 10 in a plug-in manner. An end of the control handle 12 is extended to between the first handle 2 and the second handle 4 and is located at sides of the first handle 2 and the second handle 4 proximate to the feed groove 61. When an operator presses the control handle 12, the cutting bit 9 can be controlled to rotate in the cutting groove 8.

A use method of this embodiment is as follows: a tail of the tie is made to pass through the feed groove 61 and the fastening groove 71 in turn, and a fastening part of the tie abuts against an inlet of the feed groove 61 (a left end of the feed head 6). At this time, the operator can make the first support 1 and the second support 3 rotate reciprocally by continuously pressing the first handle 2 and the second handle 4. During reciprocating rotation of the first support 1 and the second support 3, the fastening component 7 drives the tail of the tie to move backward, and finally tightens the tie. After that, the operator can indirectly control the cutting bit 9 to rotate in the cutting groove 8 to a joint of the cutting groove 8 and the feed groove 61 by pushing the control handle 12, and cut off the redundant tail of the tie.

For this tie plier, the end of the control handle 12 is extended to between the first handle 2 and the second handle 4 and located at sides of the first handle 2 and the second handle 4 proximate to the feed groove 61, so that the operator can control operations of the control handle 12, the first handle 2 and the second handle 4 with one hand. When a tail of the tie needs to be cut, the cutting bit 9 can be driven to move in the cutting groove 8 by pushing the control handle 12 with a thumb. At this time, the other hand of the operator can hold an article bundled by the tie, so as to prevent the article from falling and being damaged due to loss of a supporting force after the tail of the tie is cut. Compared with two-handed operations, the tie plier brings great convenience to the operator, with a simpler and more efficient operation mode, and facilitates reducing of working intensity of the operator.

As an alternative of this embodiment, the end of the control handle 12 is extended to upper-middle parts of the first handle 2 and the second handle 4. When hands of the operator hold the first handle 2 and the second handle 4 respectively, the thumbs of the operator is just at the upper-middle parts of the first handle 2 and the second handle 4. With the end of the control handle 12 provided in the upper-middle parts of the first handle 2 and the second handle 4, it is convenient for the user to push the control handle 12 with the thumbs.

As an alternative of the disclosure, the cutting bit 9 is arranged in a lower half circle of the cutting groove 8, and the end of the control handle 12 is arranged below the cutting bit 9. With the above-mentioned structural design, when the operator pushes the control handle 12 forward with his thumbs, the cutting bit 9 rotates clockwise in the cutting groove 8. Since the cutting bit 9 is arranged in the lower half circle of the cutting groove 8, an end of the cutting bit 9 proximate to the inlet of the feed groove 61 moves upward to cut a tail end of the tie, and in this way, there is an advantage that the tail end of the cut tie is smaller, with a better cutting effect and without a secondary cutting.

As an alternative of the disclosure, the fastening component 7 includes a fastening seat 72 fixedly connected to the second support 3 by screws and a fastener 73 rotatably connected to the fastening seat 72 by a movable shaft. The fastener 73 has a triangular shape, and a blocking part 74 is fixedly connected above the fastening seat 72, and a fastening groove 71 is formed between the fastener 73 and the blocking part 74. The fastener 73 includes a limiting end 731 and a fastening end 732, both of which are arranged below the fastening groove 71. The limiting end 731 is proximate to the feed head 6 and the fastening end 732 is away from the feed head 6. When the fastening seat 72 rotates with the second support 3 relative to the first support 1, the fastening seat 72 drives the fastener 73 to act together. During rotation of the fastener 73, the limiting end 731 will abut against the tail of the tie, and at this time, the fastener 73 cannot continue to rotate relative to the tie. During continuous rotation of the fastening seat 72, the fastening groove 71 formed between the fastening end 732 and the blocking part 74 gradually shrinks until the tail of the tie is clamped. At this time, when the fastening seat 72 continues to rotating, the tie can be tightened by driving the tail of the tie to move backward with a clamping force between the fastening end 732 and the blocking part 74.

As an alternative of the disclosure, in order to improve clamping effect of the fastening end 732 on the tail of the tie, the fastening end 732 is integrally provided with a plurality of fastening teeth 733.

As an alternative of the disclosure, the second support 3 is rotatably connected to the first support 1 through the movable shaft 13 and the first support 1 is provided with an arc-shaped groove 14 with the movable shaft 13 as a circle center. Two ends of the arc-shaped groove 14 are respectively provided with a first fixed post 141 and a second fixed post 142. The first fixed post 141 is arranged on the first support 1 and the second fixed post 142 is arranged on the second support 3. The first elastic member 5 is a spring, and two ends of the spring are respectively sleeved on the first fixed post 141 and the second fixed post 142. When there is relative rotation between the first support 1 and the second support 3, the first elastic member 5 can contract in the arc-shaped groove 14, and the first fixing post 141 and the second fixing post 142 can prevent the first elastic member 5 from falling off, thus improving fixing effect of the first elastic member 5. With a above-mentioned structural design, service life of the first elastic member 5 is greatly prolonged.

As an alternative of the disclosure, the end of the control handle 12 is fixedly connected with a force applying part 121. The rod-shaped control handle 12 is prone to slipping when pushed by the operator. With provision of the force applying part 121, the operator can push the control handle 12 by applying a force to the force applying part 121, improving stability of the operator when the control handle 12 is pushed.

As an alternative of the disclosure, the force applying part 121 is a sphere, and a surface of the sphere is smooth, which makes the force applying part 121 to be felt better when pushed by a user. Compared with a structure with a different shape, processing and molding methods are simpler, which facilitates reducing of processing cost.

In another possible embodiment, in order to reduce occurrence of slipping caused by a reduced spring force or other deformation of a connecting shaft in use, and increase the service life of the tie plier or reduce adverse effect caused by machining errors, in addition to the structure of the tie plier described above, the tie plier further includes an adjusting component 75 which is provided on the fastening component and used for adjusting an initial distance between the fastening groove and the blocking part 74. A protruding end 751 of the adjusting component passes through the blocking part 74 and out of the blocking part to reduce the initial distance between the fastening groove and the blocking part 74. Here, when the initial distance between the fastening groove and the blocking part 74 is calculated, the adjusting component is regarded as a part of the blocking part. The initial distance refers to a distance between the fastening groove and the blocking part when the tie plier does not start working, the operator has not performed a pressing action and the fastener has not moved. Moreover, a screw connection can be made between the adjusting component and the blocking part to keep a height of the protruding end of the adjusting component protruding from the blocking part 74 adjustable, so as to adjust the initial distance between the fastening groove and the blocking part 74. The more the protruding end of the adjusting component protrudes from the blocking part, the smaller the initial distance between the fastening groove and the blocking part 74 is, and both sides of the tie are respectively stressed by the fastening groove and the protruding end. When the initial distance between the fastening groove and the blocking part 74 is decreased, the tie is more stressed by the fastening groove and the protruding end, and is pressed and engaged more tightly. After the initial distance between the fastening groove and the blocking part 74 can be adjusted, influences caused by the reduced spring force or other deformation of the connecting shaft or machining error can be canceled. Optionally, the adjusting component 75 can be a screw element, such as a screw, a bolt, etc., and an adjusting mode of the adjusting component can be that of a rotating screw element.

Optionally, a side of the fastening groove facing the blocking part is provided with fastening teeth, and the protruding end 751 of the adjusting component is arranged correspondingly to the fastening teeth of the fastening groove.

Optionally, in order to fix a position of the adjusted adjusting component, a medium-strength threadlocker is filled between the screw element and a screw hole of the blocking part, or a spring or gasket is provided between the screw element and the blocking part.

The present disclosure and embodiments thereof are described above in an illustrative manner, which is not restrictive; and what is shown in the drawings is only one of the embodiments of the present disclosure, and its actual structure is not limited thereto. Therefore, structures and embodiments similar to the technical scheme designed by those of ordinary skills in the art inspired by this disclosure without creativity, without departing from the creative purpose of the present disclosure, are all within a protection scope of the present disclosure.

What is claimed is:

1. A tie plier, comprising:

a first support fixedly connected with a first handle;

a second support rotatably connected to the first support and fixedly connected with a second handle;

a first elastic member for driving the first support and the second support to reset;

a feed head fixedly connected to the first support and provided with a feed groove;

a fastening component provided on the second support and on a same side as the feed head, and provided with a fastening groove;

a cutting groove cylindrically provided on the feed head and communicated with the feed groove; and a cutting bit which is semi-cylindrically provided in the cutting groove and is rotatable in the cutting groove, wherein the first support is provided with a rotating shaft for controlling rotation of the cutting bit and a second elastic member for driving the rotating shaft to reset, the rotating shaft being fixedly connected with a control handle, an end of the control handle being extended to between the first handle and the second handle and being located at sides of the first handle and the second handle proximate to the feed groove;

wherein the fastening component comprises a fastening seat fixedly connected to the second support and a fastener rotatably connected in the fastening seat, a blocking part being fixedly connected above the fastening seat and the fastening groove being formed between the fastener, the blocking part and the fastener comprising a limiting end and a fastening end, the limiting end being proximate to the feed head and the fastening end being away from the feed head;

wherein the tie plier further comprises an adjusting component which is arranged on the fastening component and used for adjusting an initial distance between the fastening groove and the blocking part.

2. The tie plier according to claim 1, wherein the cutting bit is arranged in a lower half circle of the cutting groove, and the end of the control handle is arranged below the cutting bit.

3. The tie plier according to claim 1, wherein the fastening end is provided with a plurality of fastening teeth.

4. The tie plier according to claim 1, wherein the second support is rotatably connected to the first support through a movable shaft, and the first support is provided with an arc-shaped groove with the movable shaft as a circle center, and two ends of the arc-shaped groove are respectively provided with a first fixed post and a second fixed post, the first fixed post being arranged on the first support and the second fixed post being arranged on the second support, the first elastic member being a spring, and two ends of the spring being respectively sleeved on the first fixed post and the second fixed post.

5. The tie plier according to claim 1, wherein the end of the control handle is fixedly connected with a force applying part.

6. The tie plier according to claim 5, wherein the force applying part is a sphere.

7. The tie plier according to claim 1, wherein the end of the control handle is extended to upper-middle parts of the first handle and the second handle.

8. The tie plier according to claim 1, wherein a protruding end of the adjusting component passes through and out of the blocking part to reduce the initial distance between the fastening groove and the blocking part.

9. The tie plier according to claim 1, wherein a screw connection can be made between the adjusting component and the blocking part to keep a height of the protruding end of the adjusting component protruding from the blocking part adjustable, so as to adjust the initial distance between the fastening groove and the blocking part.

10. The tie plier according to claim 1, wherein a side of the fastening groove facing the blocking part is provided with fastening teeth, and the protruding end of the adjusting component is arranged correspondingly to the fastening teeth of the fastening groove.

11. The tie plier according to claim 1, wherein the adjusting component is a screw member.

12. The tie plier according to claim 11, wherein a medium-strength threadlocker is filled between the screw element and a screw hole of the blocking part to fix a position of an adjusted adjusting component.

13. The tie plier according to claim 11, wherein a spring or gasket is provided between the screw element and the blocking part to fix a position of an adjusted adjusting component.

* * * * *